US005812059A

United States Patent [19]

Shaw et al.

[11] Patent Number: 5,812,059

[45] Date of Patent: Sep. 22, 1998

[54] METHOD AND SYSTEM FOR IMPROVING HAND CLEANLINESS

[75] Inventors: Daniel C. Shaw, Geneva; Lee M. Adler, Altamonte Spring, both of Fla.

[73] Assignee: Sloan Valve Company, Franklin Park, Ill.

[21] Appl. No.: 605,991

[22] Filed: Feb. 23, 1996

[51] Int. Cl.[6] ..... G08B 23/00

[52] U.S. Cl. ..... 340/573; 340/539; 340/691

[58] Field of Search ..... 340/286.09, 286.07, 340/573, 691, 541, 567, 545, 539; 367/93; 455/88

[56] References Cited

U.S. PATENT DOCUMENTS

| | | | |
|---|---|---|---|
| 3,967,478 | 7/1976 | Guinn | 340/573 |
| 4,158,197 | 6/1979 | Takagaki | 340/574 |
| 4,598,275 | 7/1986 | Ross et al. | 340/573 |
| 4,654,793 | 3/1987 | Elrod | 364/401 |
| 4,837,559 | 6/1989 | Green, Sr. | 340/573 |
| 4,896,144 | 1/1990 | Bogstad | 340/691 |
| 5,031,258 | 7/1981 | Shaw | 4/623 |
| 5,103,474 | 4/1992 | Stoodley et al. | 379/58 |
| 5,135,721 | 8/1992 | Richard | 422/111 |
| 5,202,666 | 4/1993 | Knippscheer | 340/573 |
| 5,307,763 | 5/1994 | Arthur et al. | 119/718 |
| 5,341,126 | 8/1994 | Boykin | 340/573 |
| 5,610,589 | 3/1997 | Evans et al. | 340/573 |

FOREIGN PATENT DOCUMENTS

| | | |
|---|---|---|
| 0640947 | 3/1995 | European Pat. Off. . |
| 9213327 | 8/1992 | WIPO . |

*Primary Examiner*—Daniel J. Wu
*Attorney, Agent, or Firm*—Joseph W. Berenato, III

[57] ABSTRACT

A system and corresponding method for enhancing hygiene in a food handling environment include an indicator to be worn by a worker in the food handling area, an activating device located outside of the food handling area, a hand cleaning station located proximate or within the food handling area (remote from the restroom), and a deactivating device operatively associated with the hand cleaning station. Upon leaving the food handling area, the indicator worn by the worker is activated when the worker enters a predetermined area proximate the activating device. Thereafter, the indicator is deactivated by the deactivating device only when it is determined that the worker has utilized the hand cleaning station proximate the food handling area. In such a manner, the prior art problem of worker contamination occurring between, for example, the restroom and food handling area is substantially eliminated. According to alternative embodiments, the system and method may be used in hospital environments so as to prevent germs from spreading from one patient to another by way of medical personnel.

13 Claims, 9 Drawing Sheets

METHOD AND SYSTEM FOR IMPROVING HAND CLEANLINESS

This invention relates to a system and corresponding method for enhancing worker hygiene in a food handling environment. More particularly, this invention relates to such a system including an indicator to be worn by a worker, an indicator activating device located outside of the food handling area, and an indicator deactivating device operatively associated with a hand cleaning station located proximate or within the food handling area.

BACKGROUND OF THE INVENTION

Many diseases and/or viruses are spread from one person to another through contact, either direct or indirect. This is a substantial concern in food handling environments, such as in restaurants, food processing plants, etc., as well as in hospitals.

In response to this concern, the following systems and corresponding methods have been developed. U.S. Pat. No. 5,202,666 discloses a method and apparatus for enhancing hygiene in food handling environments, hospitals, etc. where hand cleanliness is particularly crucial. The system of the '666 patent includes a sensor for generating a first signal upon automatically sensing that an individual has entered a washroom and for generating a second signal upon detection that the individual has exited the washroom. The system further includes a monitor for determining whether the individual has cleaned his/her hands in the washroom (or restroom) and a corresponding generator for producing a third signal upon detection by the monitor that the individual has cleaned his hands. An alarm or alert signal is emitted by an indicator worn by the individual when it is determined that the indicator has received the first and second signals, but not the third signal, thereby indicating possible contamination of the individual (i.e. because his/her hands were not cleaned in the washroom). In such a manner, a system of the '666 patent functions to indicate whether or not individuals who leave the food handling area and enter a bathroom/washroom clean their hands before leaving the bathroom/washroom. If the hands are not cleaned in the washroom, the alert or alarm signal is generated.

Unfortunately, the system and corresponding method of U.S. Pat. No. 5,202,666 do not take into consideration possible contamination which may occur between the washroom and the food handling area. For example, an individual, after leaving the bathroom/washroom, may decide to take out the trash and become contaminated with germs or the like in the process of doing so. If this were to occur, with the individual reentering the food handling area after taking out the trash, the indicator of the '666 patent would not generate an alarm signal indicating contamination. This is a problem.

U.S. Pat. No. 4,896,144 discloses a hand washing alert system including a warning system which is armed proximate a bathroom and deactivated upon actuation of hand washing facilities. The '144 system may be used in a bathroom with the warning system being activated upon either flushing of a toilet or entry into the bathroom and deactivated when it is determined that the person has washed their hands in the bathroom. Unfortunately, the system disclosed in the '144 patent suffers from the problem discussed above relative to the '666 patent in that it does not take into consideration possible contamination which may occur between the washroom and the food handling area or other clean area such as an operating or patient room in a hospital.

In view of the above, it is apparent that there exists a need in the art for a system and corresponding method for enhancing hygiene in food handling environments (and hospitals) wherein the problem of worker/employee contamination between the restroom and he clean area is taken into consideration and substantially eliminated.

SUMMARY OF THE INVENTION

Generally speaking, this invention fulfills the above-described needs in the art by providing a method of enhancing hand cleanliness in an environment requiring clean hands such as a restaurant or hospital, the method comprising the steps of:

providing a clean area where clean hands are required;

activating an indicator worn by a user at a location outside of the clean area;

providing a hand cleaning station within the clean area; and deactivating the indicator when it is determined that the user has utilized the hand cleaning station so that the indicator is switched to a deactivated state when the user has clean hands in the clean area.

This invention still further fulfills the above-described needs in the art by providing a system for enhancing worker hygiene in a food handling environment including a food handling area and a bathroom, the system comprising:

an indicator to be worn by a worker in the food handling environment, the indicator for generating an alarm signal indicative of possible worker contamination when in an activated state;

an activating device located outside of the food handling area, the activating device for emitting a first signal which activates the indicator;

a hand cleaning station located proximate the food handling area and remote from the bathroom, the hand cleaning station for allowing the worker wearing the indicator to clean his/her hands before handling food; and a deactivating device operatively associated with the hand cleaning station disposed proximate the food handling area, the deactivating device emitting a second signal which deactivates the indicator when it is determined that the user has used the hand cleaning station whereby the possibility of worker contamination in the food handling area is reduced.

According to certain preferred embodiments of this invention, the hand cleaning station and deactivating device are located within the food handling area.

This invention will now be described with respect to certain embodiments thereof, accompanied by certain illustrations wherein:

IN THE DRAWINGS

DETAILED DESCRIPTION OF CERTAIN EMBODIMENTS OF THIS INVENTION

Figure 1:
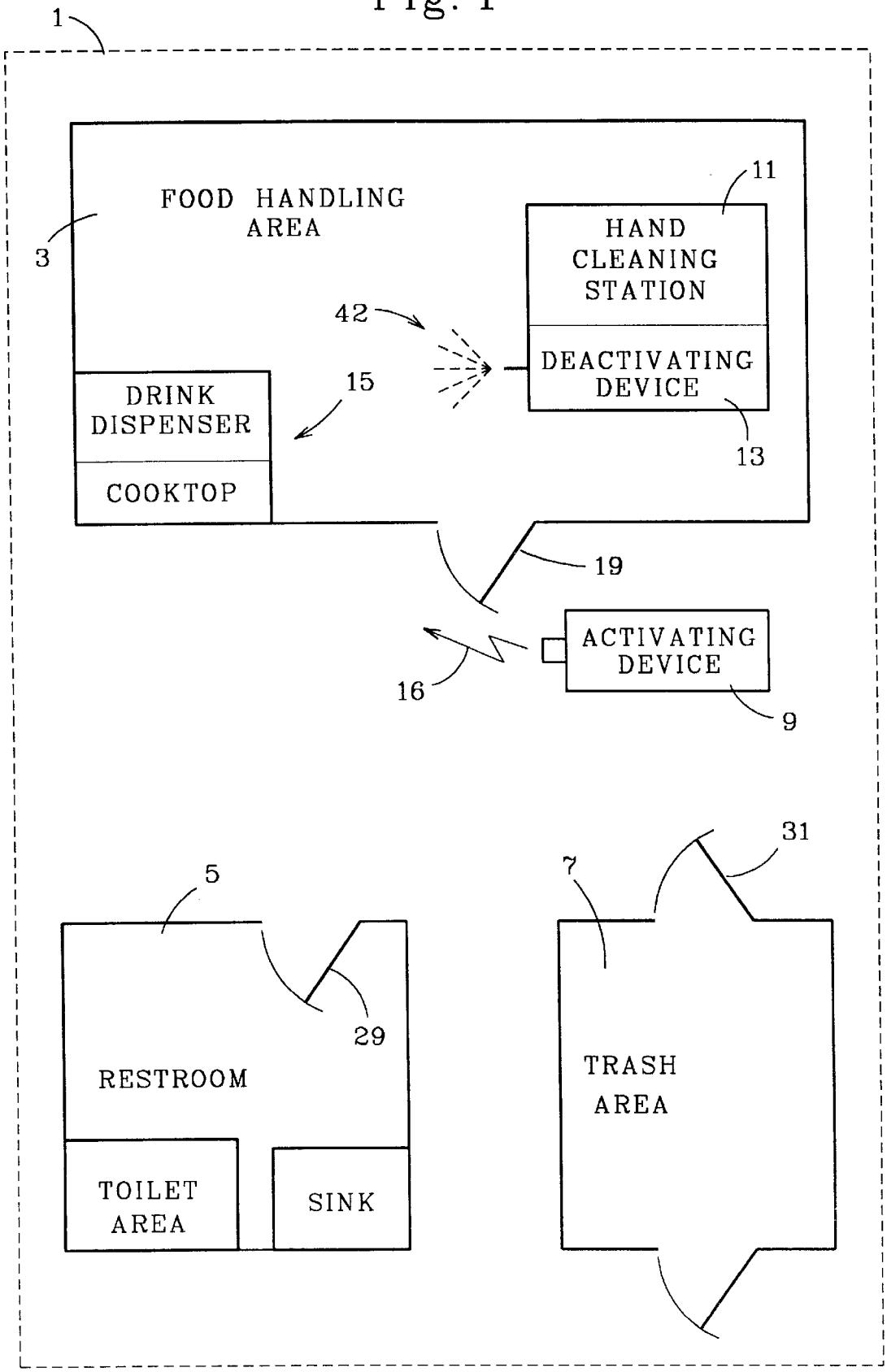
FIG. 1 is a schematic view illustrating a system/method for enhancing hand cleanliness in a food handling environment according to a first embodiment of this invention.

Referring now more particularly to the accompanying drawings in which like reference numerals indicate like parts throughout the several views.

FIG. 1 is a schematic view of a system/method for enhancing hand cleanliness within food handling environment 1 according to a first embodiment of this invention. Environment 1 includes food handling area 3, restroom 5, trash area 7, indicator activating device 9 located outside of food handling area 3, hand cleaning station 11 located within food handling area 3, indicator deactivating device 13 operatively associated with hand cleaning station 11, and drink dispenser and cooktop devices 15 disposed within area 3. Optionally, station 11 and deactivating device 13 may be located outside of area 3, but still proximate the food handling area (e.g. near doorway 19). Activating device 9 and deactivating device 13 are remotely located relative to one another.

In sum, the system enhances hand cleanliness in food handling area 3 in that activating device 9 continuously outputs activating signal 16 for the purpose of activating passive indicator 17 (see FIG. 6) worn by the user. Thus, indicator 17 is activated in the first embodiment as the user leaves food handling area 3 by way of doorway 19. When indicator 17 is in an "activated" state, it either immediately or after a predetermined time delay emits an alarm signal (e.g. audio, optical, or vibration type signal) indicative of potential user contamination. The user is free to use restroom/bathroom and trash area 7 after leaving area 3 while the indicator is in an activated state. Indicator 17 can only be deactivated upon the user reentering food handling area 3 and using hand cleaning station 11.

After the user cleans his/her hands at station 11, deactivating device 13 is triggered to emit signal 42 which "deactivates" indicator 17 such that the alarm signal is no longer emitted or scheduled to be emitted. Any user wearing an "activated" indicator 17 who reenters food handling area 3 and goes about his/her duties without cleaning their hands at station 11 will be targeted as potentially contaminated because their indicator 17 will remain activated and be emitting an alarm signal.

The system/method according to this invention overcomes the problems discussed above relative to the prior art in that potential contamination of a user between restroom 5 and food handling area 3 is substantially eliminated by deactivating the indicator only upon the user utilizing station 11 which is located proximate or within food handling area 3. This takes care of the situation where the user leaves restroom 5, is contaminated in trash area 7, and thereafter enters food handling area 3.

Figure 2:
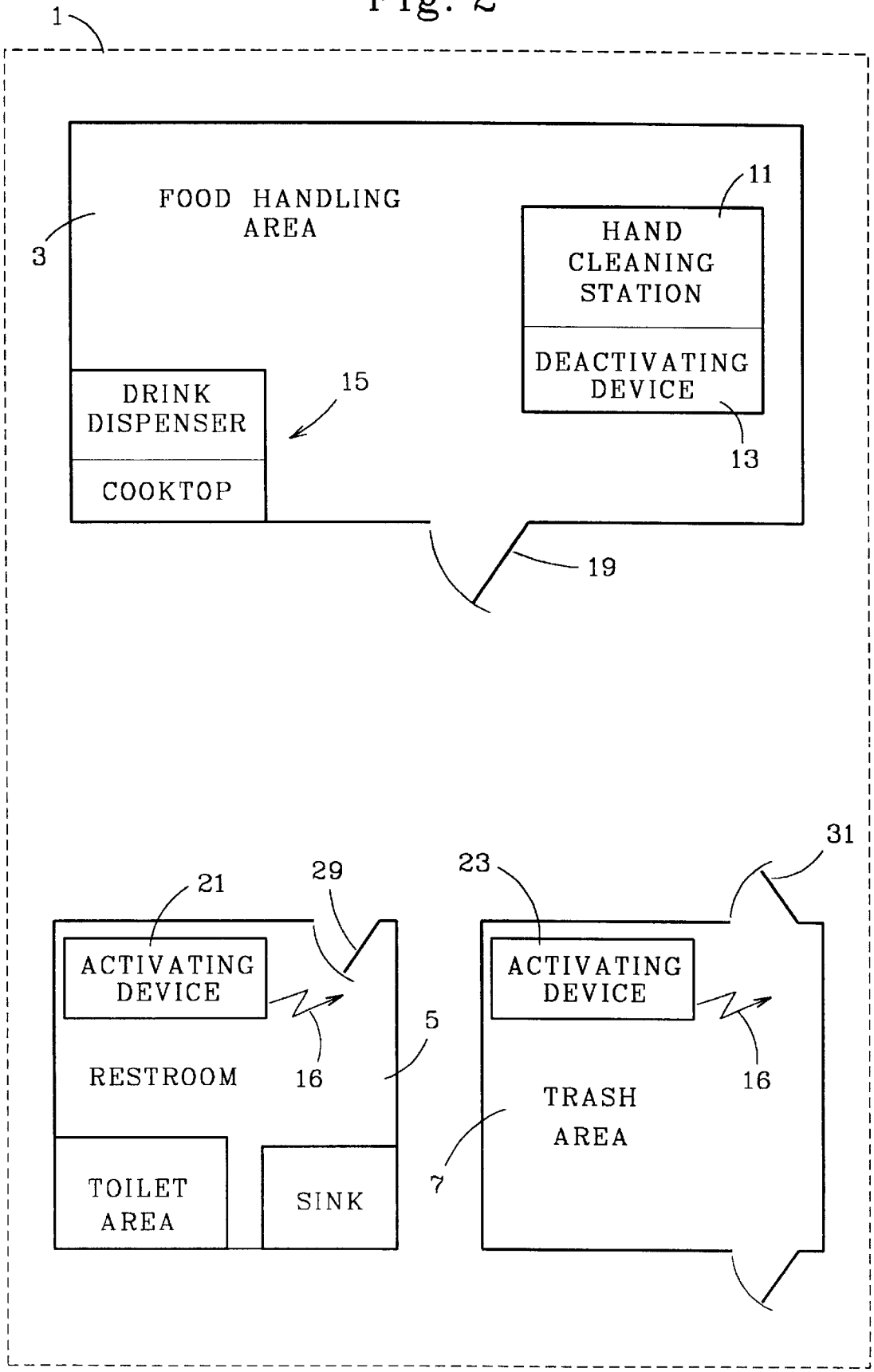
FIG. 2 is a schematic view illustrating a system/method for enhancing hand cleanliness in a food handling environment according to a second embodiment of this invention.

FIG. 2 illustrates a second embodiment of this invention similar to that shown in FIG. 1, except that activating device 9 is replaced by a pair of activating devices 21 and 23 located in restroom 5 and trash area 7 respectively. Activators 21 and 23 each continuously emit activating signals 16. Thus, when a user wearing indicator 17 leaves food area 3, the indicator is activated by way of device 21 when the user enters or leaves restroom/bathroom 5 and/or by device 23 as the user enters or leaves trash area 7. Upon reentering food handling area 3 with passive indicator 17 in the activated state, the user must clean his/her hands at station 11 before device 13 deactivates the indicator via signal 42 thereby extinguishing its alarm signal.

Figure 3:
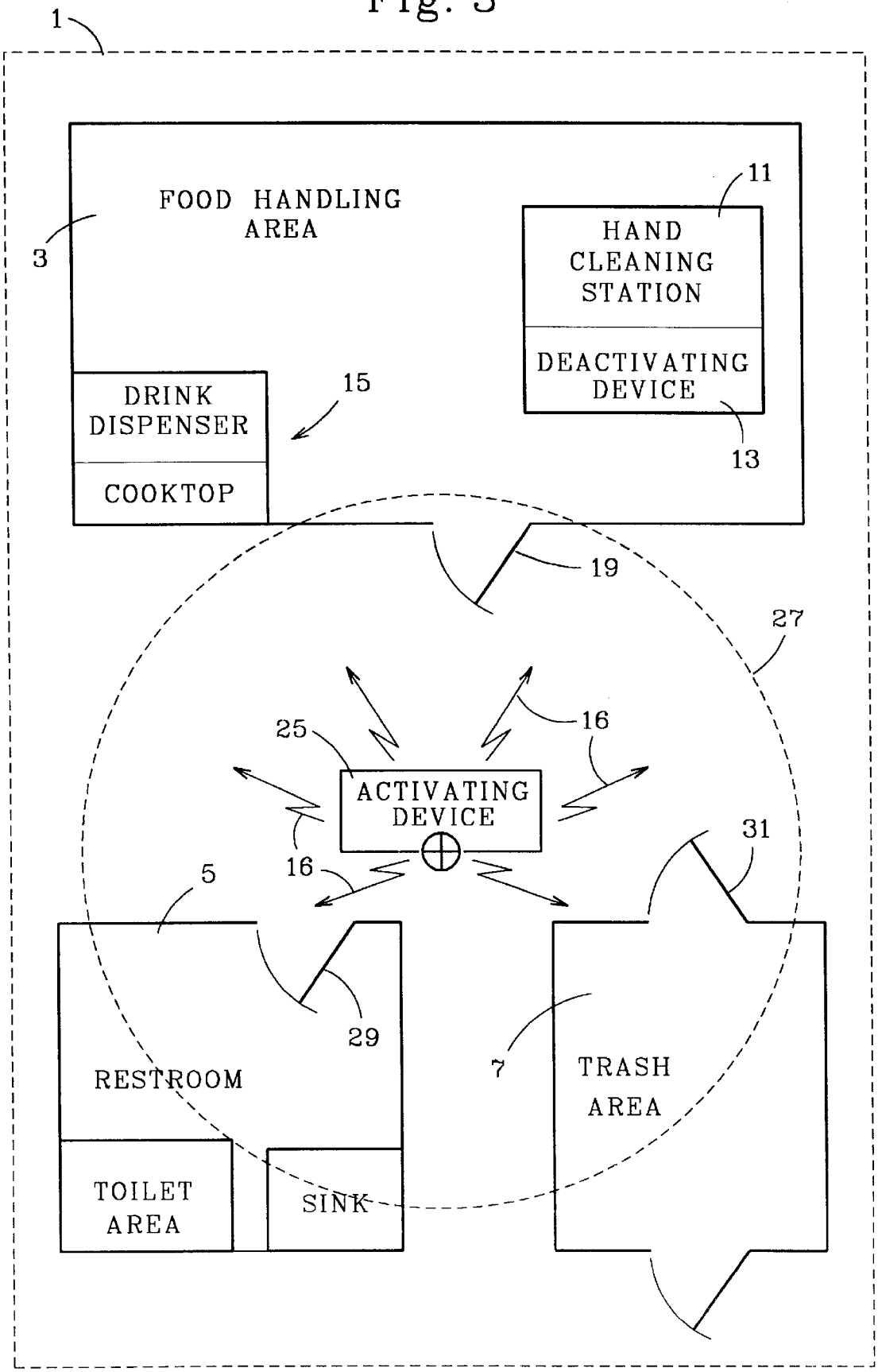
FIG. 3 is a schematic view illustrating a system/method for improving hand cleanliness in a food handling environment according to a third embodiment of this invention.

FIG. 3 is a schematic view of a third embodiment of this invention which differs from the first two embodiments in that indicator activation device 25 is provided in a common area of enviroment 1 outside of food handling area 3, whereby device 25 continuously emits activating signal(s) 16 which reach restroom 5, trash area 7, and doorway area 19. The activating signal(s) 16 output by device 25 are confined within substantially circular signal area 27. Accordingly, indicator 17 worn by any user whom: (i) leaves food handling area 3 by way of door 19; (ii) enters or leaves restroom 5 by way of door 29; or (iii) enters or leaves trash area 7 by way of door 31, is activated by signal 16. Upon reentering food handling area 3, indicator 17 remains in the activated and alarm signal emitting state unless deactivated by device 13 following use of station 11.

Activating signal(s) 16 (and deactivating signal(s) 42) may be low power RF or alternatively infrared (IR) signals limited to a predetermined emittance area. In the FIG. 1 embodiment, for example, an RF or IR shielding device (not shown) may be disposed in and about door area 19 (in a wall or door) so as to prevent signals 16 from entering area 3, and for preventing deactivating signals from station 11 reaching a tag 17 worn outside of area 3.

Figure 4:
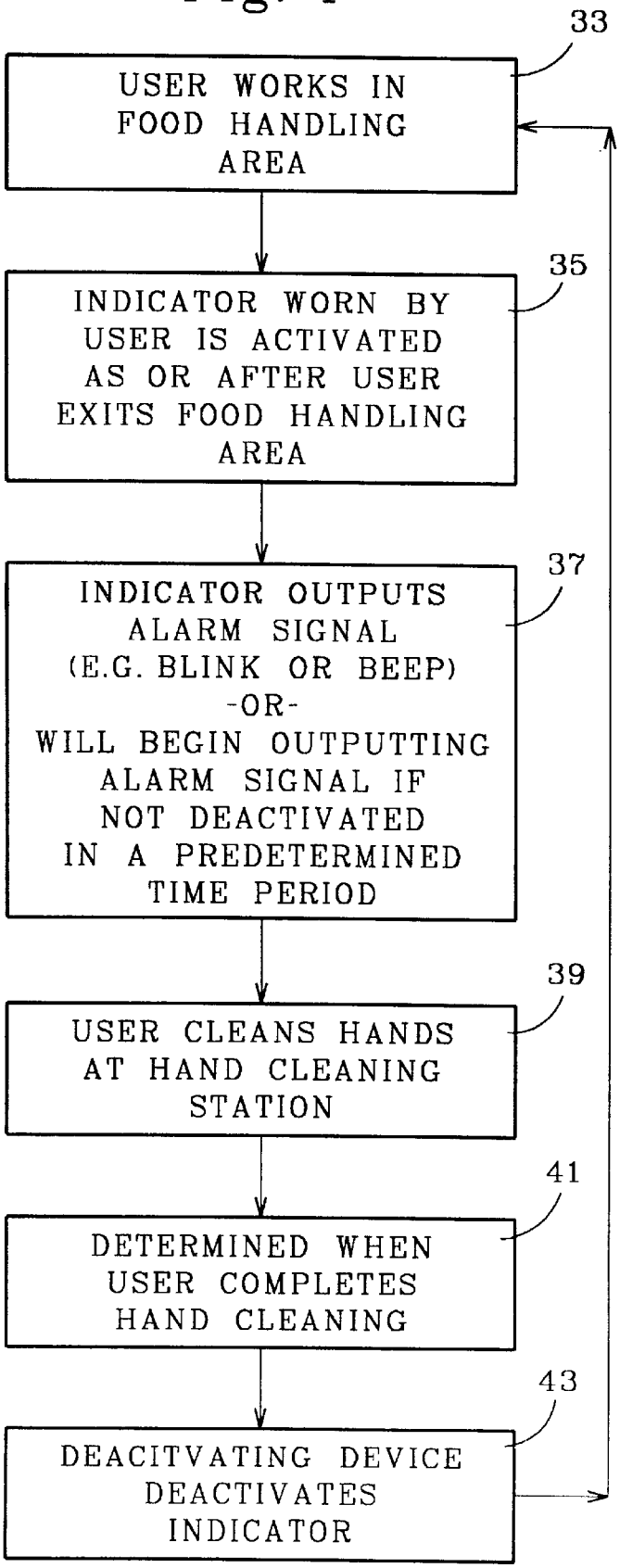
FIG. 4 is a flowchart illustrating steps taken by the systems shown in FIGS. 1–3 for the purpose of enhancing hand cleanliness in the food handling environment.

FIG. 4 is a flowchart illustrating the system of FIGS. 1–3 in operation. The process begins with the user or worker wearing indicator 17 in food handling area 3 while performing his/her duties at 33. As, or after, the user leaves food handling area 3, the indicator 17 being worn by the user is activated by signal 16 in step 35. As shown in FIGS. 1–3, activating step 35 may take place either proximate the exterior of food handling area 3 (FIG. 1), in restroom 5, in trash area 7 (FIG. 2), or in a common area 27 outside of food handling area 3 (FIG. 3).

By receiving signal 16, indicator 17 is placed in an "activated" state which translates into the indicator either immediately or after a predetermined delay period emitting an alarm signal at 37. Exemplary alarm signals include audio beeps, optical blinks, and vibration type signals. Additionally, the predetermined delay period may be, for example, from about 3–15 minutes depending upon the particular application of the invention, although other time periods may also be used.

When indicator 17 is an activated state, the user is free to do just about anything except work in food handling area 3 without cleaning his/her hands. There is no cause for concern if indicator 17 is emitting an alarm signal, for example, when a user is taking out the trash (this is expected).

Upon reentering food handling area 3, indicator 17 will continue to emit an alarm signal putting surrounding personnel on notice of the user's potential contamination until station 11 is utilized by the user for the purpose of cleaning his/her hands at 39. In step 41, it is determined or detected when the user has completed cleaning his/her hands at station 11. Following completion, deactivating device 13 is triggered to emit deactivating signal 42 in step 43 for the purpose of placing indicator 17 in a deactivated state. Thereafter, the user is free to resume his/her duties in food handling area 3 without having indicator 17 emit an alarm signal.

Figure 5:
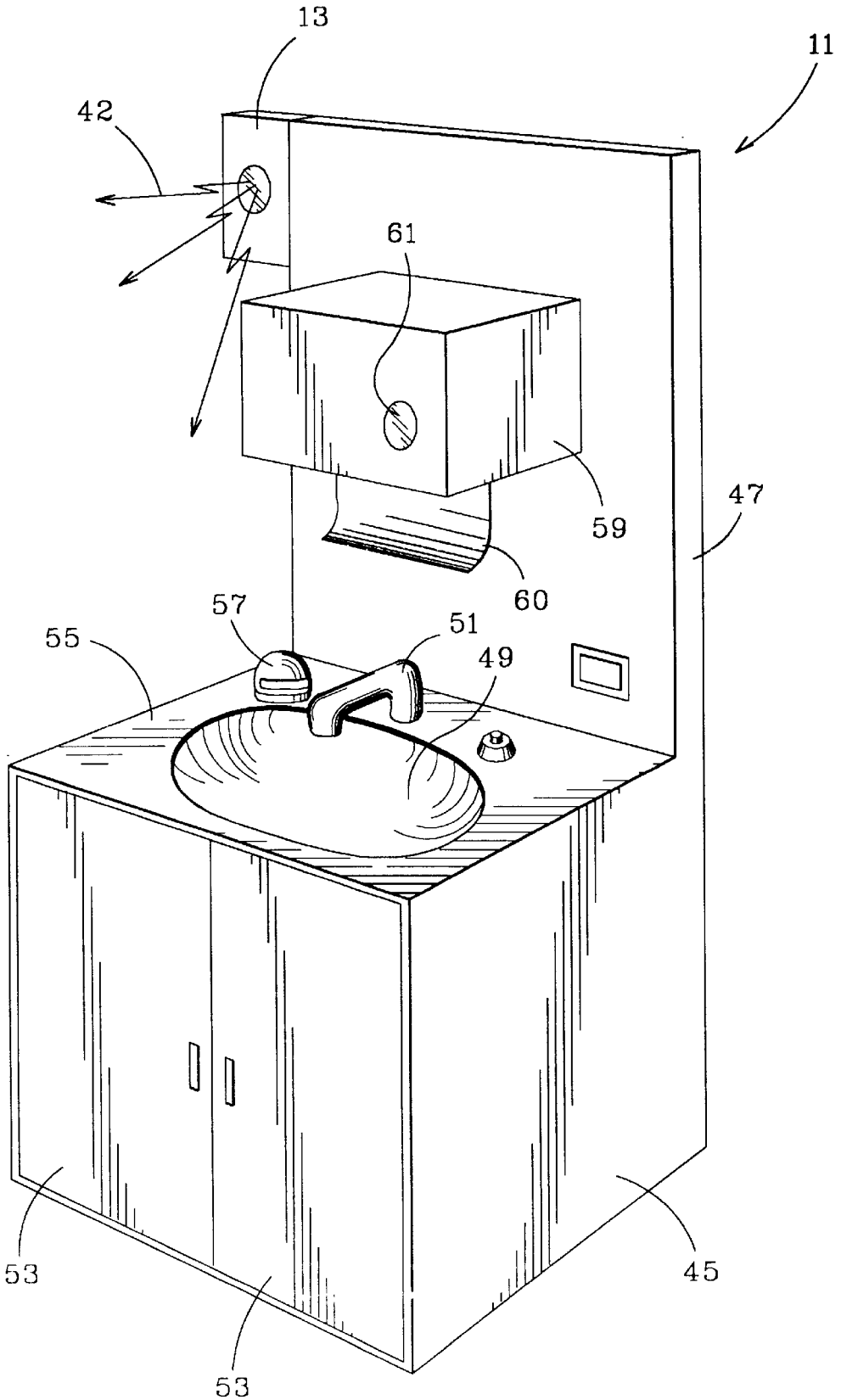
FIG. 5 is a perspective view illustrating the hand cleaning station and corresponding deactivating device of FIGS. 1–3.

FIG. 5 is a perspective view of hand cleaning station 11 operatively coupled to deactivating device 13. As shown, hand cleaning station 11 includes cabinet 45, vertical support 47, sink 49, faucet 51, doors 53, sink top 55, infrared sensor 57 for determining when faucet 51 should output water, dispenser 59 for dispensing toweling 60, and infrared sensor 61 for determining when dispenser 59 should output toweling 60. Hand cleaning station 11 is described in further detail in U.S. Pat. No. 5,031,258, the disclosure of which is hereby incorporated herein by reference.

As shown in FIG. 5, deactivating device 13 is operatively associated with hand cleaning station 11 so that deactivating signal 42 is only emitted upon determination that the user has completed cleaning his/her hands at station 11. For example, deactivating device 13 may be coupled to station 11 so that signal 42 is only emitted after infrared sensor 61 causes dispenser 59 to dispense toweling which is utilized by the user. Follwing the dispensing of toweling 60, deactivating device 13 may be triggered to output signal 42 thereby ensuring that the user's hands are clean before signal 42 is emitted.

Alternatively, deactivating device 13 may be caused to output signal 42 only after sensor 57 has caused water to be output from faucet 51 and sensor 61 has caused toweling 60 to be output from dispenser 59. According to still further embodiments of this invention, deactivating device 13 may be activated upon the stoppage of water being output from faucet 51. In sum, the purpose of operatively associating deactivating device 13 with hand cleaning station 11 is to ensure that deactivating signal 42 is only emitted after the user has fully cleaned his/her hands.

Figure 6:
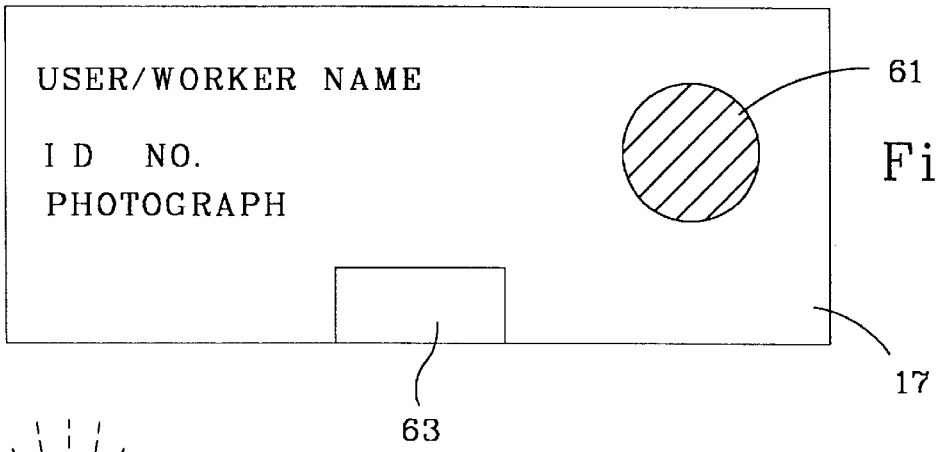
FIG. 6 is a side elevational view of an indicator to be worn by user(s).

FIG. 6 is an illustration of indicator 17 to be worn by a user or worker in environment 1. As shown, indicator 17 may have listed thereon the user's name, identification number, photograph, etc. Furthermore, each indicator 17 includes alarm signal output device 61. As discussed above, device 61 may be a speaker allowing indicator 17 to emit an audio alarm signal, or alternatively may be a light emitting diode (LED) permitting indicator 17 to emit an optical continuous or blinking alarm signal. Indicator 17 further includes receiver 63 for the purpose of receiving both activating signals 16 and deactivating signals 42.

Figure 7:
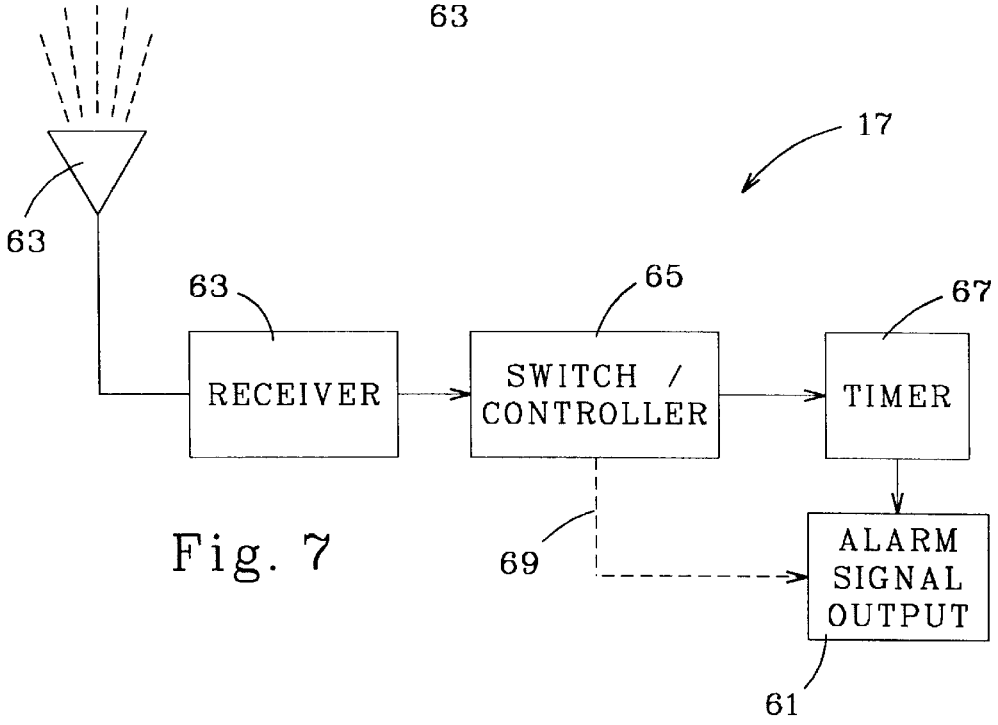
FIG. 7 is an electrical block diagram of the FIG. 6 indicator.

FIG. 7 is a block diagram of indicator 17, which includes receiver 63, switch/controller 65, timer 67, and alarm signal output device 61. Activating signals 16 are received by receiver 63, and forwarded to switch/controller 65. Depending upon the type of indicator 17, the indicator either immediately outputs an alarm signal via communication 69 to output device 61, or timer 67 is actuated so that the indicator will only begin to emit an alarm signal after a predetermined delay period of time. In both cases, the alarm signal is output via device 61.

Figure 8:
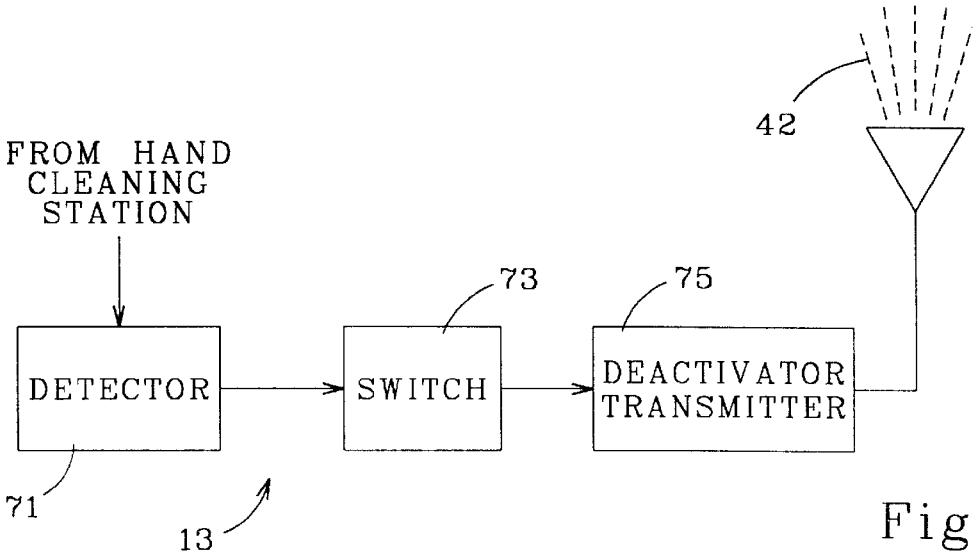
FIG. 8 is an electrical block diagram of the deactivating device shown in FIGS. 1–3 and 5.

FIG. 8 is block diagram of deactivating device 13 according to certain embodiments of this invention. Detector 71 of deactivating device 13 first receives a signal from station 11 indicative of the user having completed cleaning his/her hands (e.g. the received signal having been triggered by the water being shut off or by the towel dispensing being completed). Detector 71 causes switch 73 to activate transmitter 75 which emits deactivating signal 42 for a predetermined period of time (e.g. five seconds). Thus, deactivating device 13 is operatively associated with station 11 so that signal 42 is only emitted after it has been determined that the user has utilized station 11.

Figure 9:
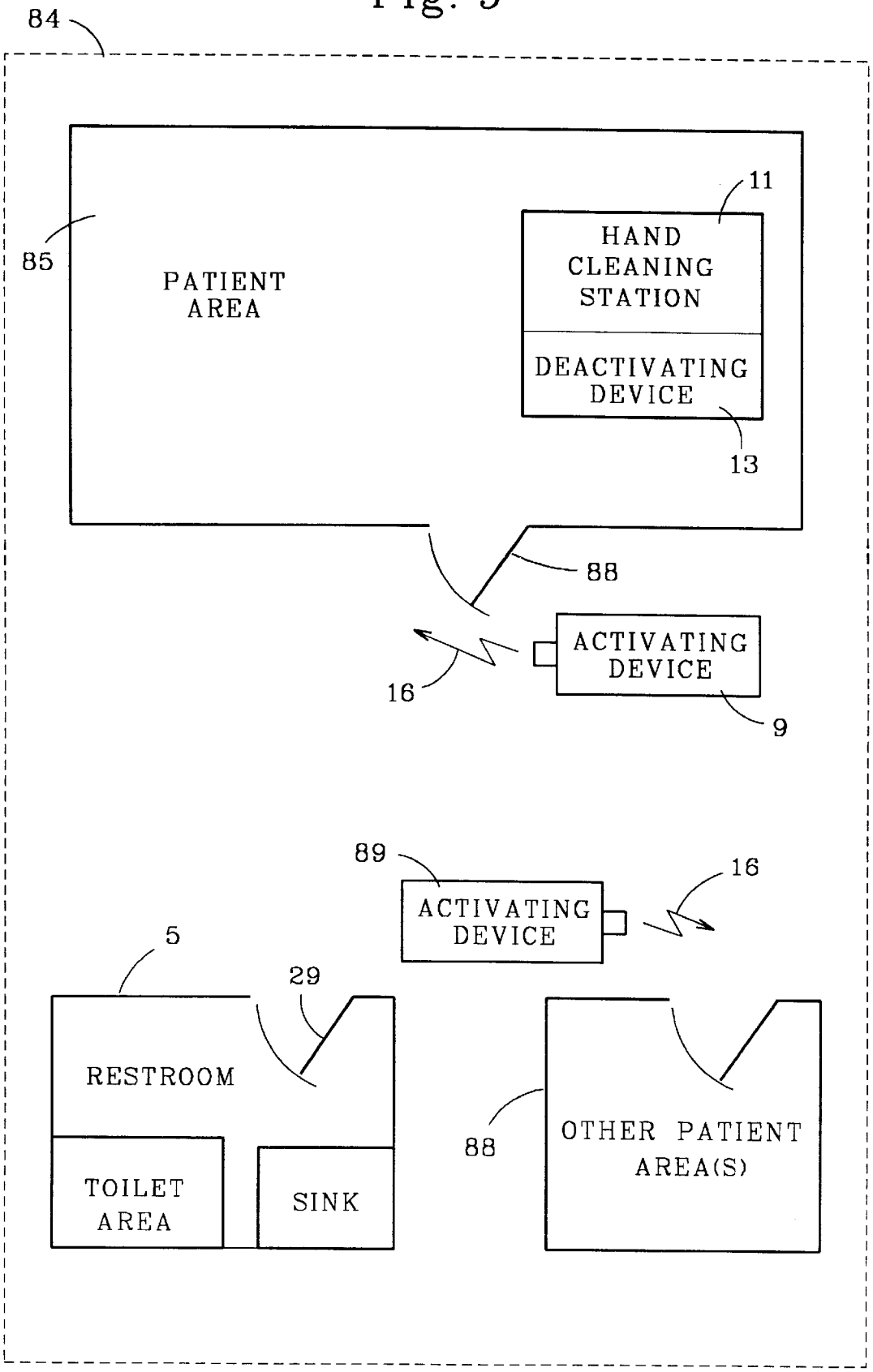
FIG. 9 is a schematic of a system/method for improving hand cleanliness in a hospital or doctor office environment according to another embodiment of this invention.

FIG. 9 is a schematic of a system/method for improving hand cleanliness in hospital environment (or doctor office environment) 84 according to another embodiment of this invention. The system according to this embodiment functions to help ensure that doctors/nurses wash their hands before handling each patient, so that germs are not conducted from one patient to another by way of medical personnel. As shown, hand cleaning station 11 with deactivating device 13 are located within (or proximate) patient area 85, while activating devices 9 and 89 are located outside of patient area 85. A plurality of additional patient areas 88 are provided in environment 84. Optionally, each such area(s) 88 may have an activating device 89 disposed exterior thereof so that doctors and nurses always enter patient areas 88 and 85 with an activated indicator 17 thereby forcing them to wash their hands before handling the patient in order to deactivate their indicator 17.

Thus, when a doctor (or nurse) wearing indicator 17 exits patient area 85, the indicator is activated by signal 16 emitted from device 9. Thereafter, the doctor is free to use restroom 5, go to lunch, take care of paper work, etc., with indicator 17 in the activated state. When the doctor reenters area 85, the indicator is activated by signal 16 (if it is not still activated) so that the doctor must use hand cleaning station 11 before device 13 deactivates the indicator. Accordingly, patients and hospital personnel are on notice that a doctor may be contaminated when his/her indicator 17 is emitting an alarm signal. Additionally, all other patient areas 88 in environment 84 are equipped with hand cleaning stations 11 operatively associated with deactivating devices 13 so that medical personnel are forced to wash their hands before seeing each patient, in order to deactivate their indicator 17.

Figure 10:
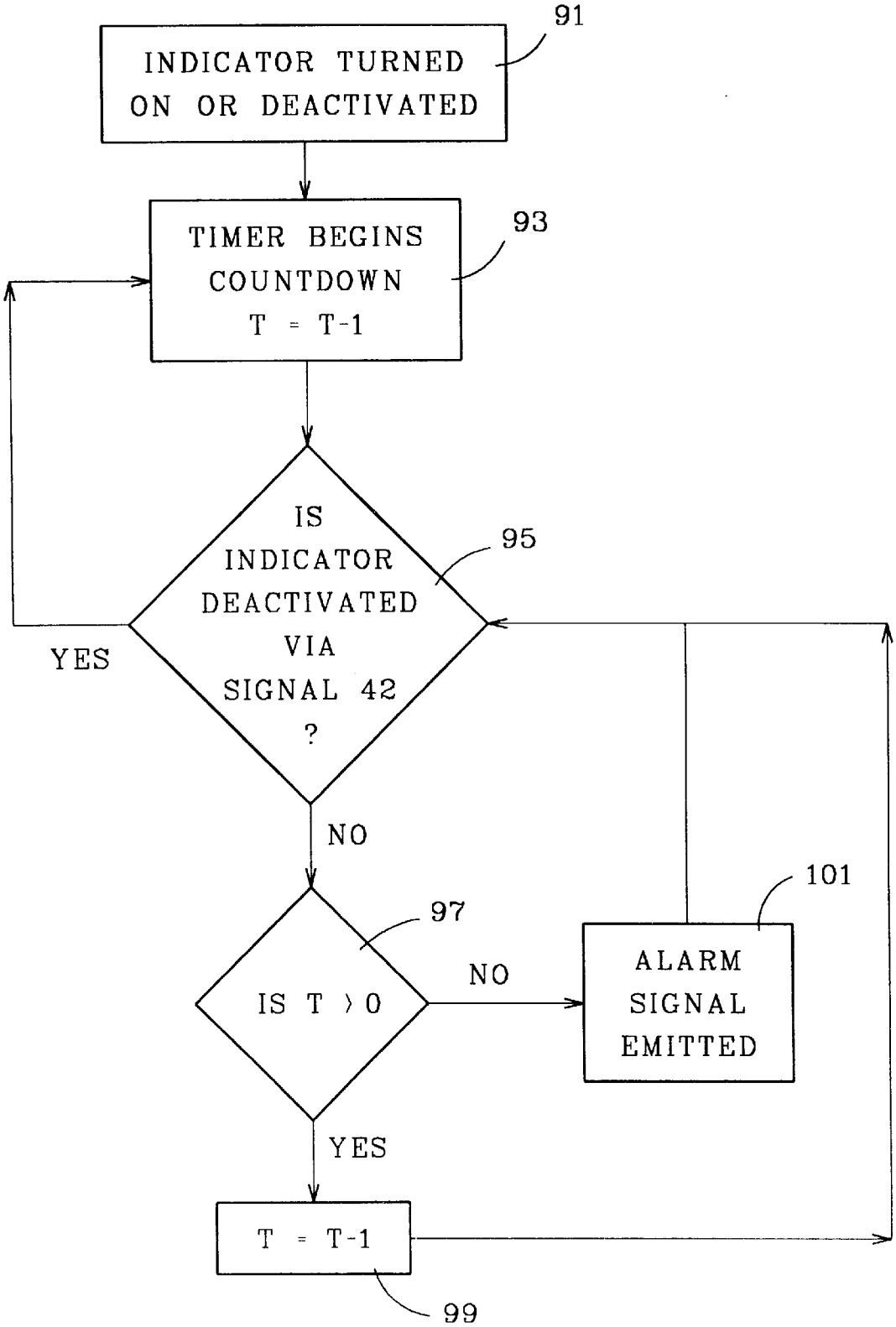
FIG. 10 is a flowchart illustrating steps taken according to yet another embodiment of this invention.

FIG. 10 is a flowchart illustrating another embodiment of this invention wherein indicator 17 is programmed to emit an alarm signal after a predetermined time period if not deactivated by signal 42. Currently, it is felt that the possibility exists for workers handling chicken, ground beef, or the like in food handling area 3 to become contaminated by same. Accordingly, a predetermined time period may be set so that, for example, indicator 17 worn by a worker handling raw chicken will begin to emit an alarm signal if not deactivated by signal 42 after twenty minutes. This ensures that all chicken handling workers wash their hands at station 11 every twenty minutes thereby reducing the risk of germs, bacteria, etc. from spreading. Likewise, a similar or different time period may be set for beef handling workers. For example, the indicator 17 of a beef handling worker may begin to emit an alarm signal if not deactivated by signal 42 following expiration of a thirty minute time period. The time period chosen is a matter of design choice and a function of the food being handled. In this manner, the likelihood of germs or bacteria residing in raw chicken being passed on to other food via worker's hands is substantially reduced, thereby resulting in a safer environment 1.

With respect to FIG. 10, the process begins at 91 with indicator 17 being turned on or deactivated by signal 42 in area 3 (or 85). Immediately following step 91, timer 94 (see FIG. 11) begins its countdown at 93 (i.e. T=T−1), with T being the time left before the alarm signal will be emitted. At step 95, it is determined whether or not the indicator 17 is receiving or has just received a deactivation signal 42. If so, step 93 is revisited (i.e. timer 94 is reset). If no deactivation signal 42 has been received, then a determination is made at 97 whether or not T is greater than 0 (i.e. whether the time period has expired). If T is found to be greater than 0, then the countdown continues at step 99. If, however, in step 97 T is found to be equal to 0 (the time period is expired), then the alarm signal is emitted at 101. The alarm signal will continue to be emitted at 101 until the wearer of the indicator 17 washes his/her hands at station 11 so that the indicator is deactivated by signal 42.

When T is found to be greater than 0 in step 97, the countdown by timer 94 continues at 99 and thereafter step 95 is again performed for the purpose of determining whether or not the indicator is or has recently received a deactivation signal 42. In such a manner, users in area 3 are required to wash their hands every so often (as dictated by the predetermined time period) in order to keep the alarm signal from being emitted at 101.

Figure 11:
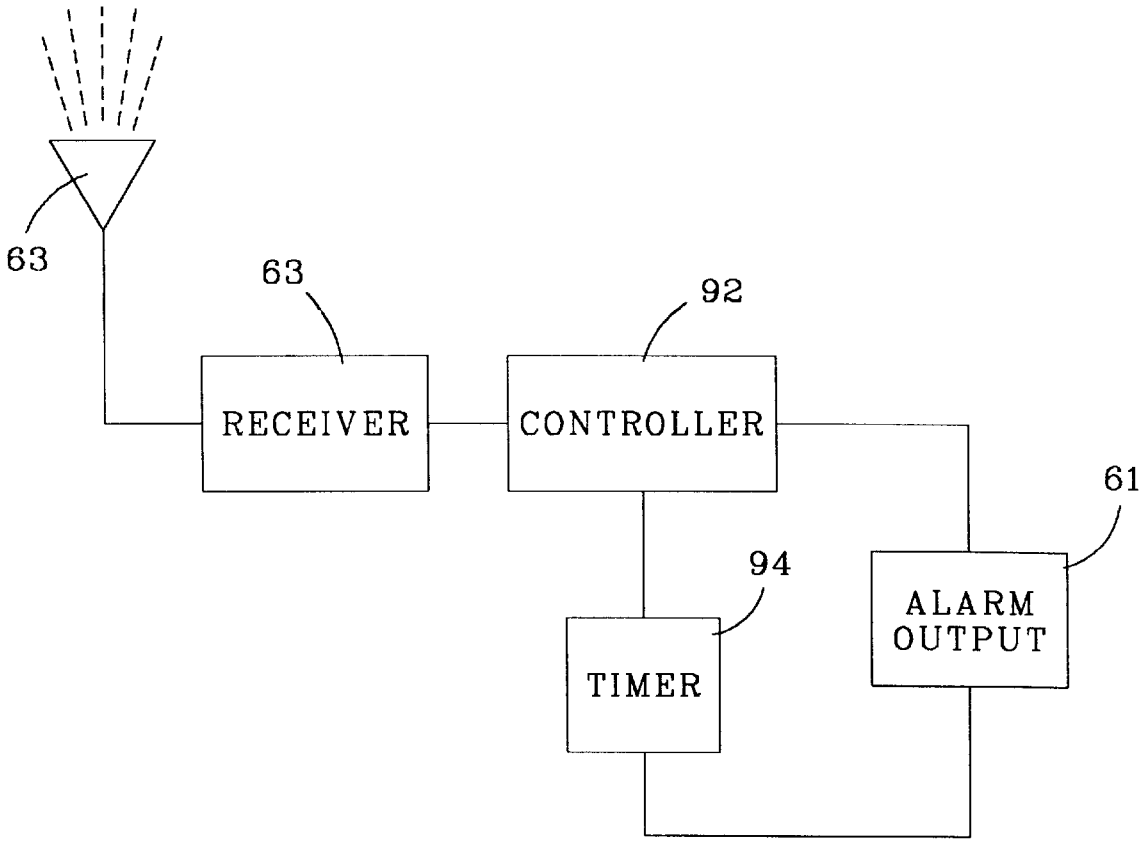
FIG. 11 is a block diagram of the indicator according to the FIG. 10 embodiment.

FIG. 11 is a block diagram of indicator 17 in accordance with the FIG. 10 embodiment. As shown, receiver 63 and alarm output 61 are as in FIG. 7. However, controller 92 and timer 94 are provided in the indicator. The predetermined time period is set by way of timer 94. Thus, timer 94 is programmed to begin its countdown at the predetermined time period (e.g. twenty minutes for raw chicken handling workers). Controller 92 functions to control the operation of timer 94 and alarm output 61. For example, controller 92 functions to reset timer 94 when necessary and begins/end alarm output signals.

Once given the above disclosure, many other features, modifications, and improvements will become apparent to the skilled artisan. Such other features, modifications, and improvements are, therefore, considered to be a part of this invention, the scope of which is to be determined by the following claims.

We claim:

1. A system for enhancing worker hygiene in a food handling environment including a food handling area and a bathroom, the system comprising:

an indicator to be worn by a worker in the food handling environment, said indicator for generating an alarm signal when in an activated state indicative of possible worker contamination, said alarm signal only being generated after a predetermined delay period has expired following activation of the indicator;

a continuously activated activating device located outside of and between said food handling area and said bathroom, said activating device for continuously emitting a first activating signal which activates said indicator when the worker wearing said indicator exits said food handling area;

a hand cleaning station located proximate said food handling area and remote from said bathroom, said hand cleaning station for allowing the worker wearing the indicator to clean his/her hands after leaving said bathroom but before handling food and before said predetermined delay period has expired; and a deactivating device operatively associated with said hand cleaning station and disposed proximate the food handling area, said deactivating device emitting a second deactivating signal which deactivates said indicator worn by the worker when it is determined that the user has used said hand cleaning station so that the possibility of worker contamination in the food handling area is reduced.

2. The system of claim 1, wherein said hand cleaning station and said deactivating device are located in said food handling area.

3. The system of claim 2, further comprising means for causing said indicator to generate the alarm signal when said indicator has not been activated for a predetermined period of time.

4. The system of claim 2, further comprising means for causing said deactivating device to emit said second signal after it has been determined that the worker has dried his/her hands by way of a towel dispenser or blower at said hand cleaning station.

5. The system of claim 1, wherein said alarm signal is generated by one of an optical light emitting device, a vibrating device, or a buzzer.

6. The system of claim 1, further comprising means for causing said indicator to generate the alarm signal when said indicator has not been deactivated from the activated state for a predetermined period of time.

7. A method of improving hand cleanliness in a food handling area, requiring clean hands, the method comprising the steps of:

providing a clean area where clean hands are required;

providing an indicator to be worn by a user in the clean area, the indicator for emitting an alarm signal if not subject to a deactivating signal within a predetermined time period;

counting down the predetermined time period;

resetting the predetermined time period upon the indicator receiving the deactivating signal, the deactivating signal being generated upon determination that the user has cleaned his/her hands at a hand cleaning station; and emitting an alarm signal from the indicator when the indicator does not receive the deactivating signal during the predetermined time period, whereby the alarm signal is emitted when the user fails to clean his/her hands before expiration of the predetermined time period.

8. The method of claim 7, wherein the clean area is a food handling area, whereby potential contamination of food by way of the user's hands is substantially reduced.

9. The method of claim 8, wherein the predetermined time period is less than about one hour, and the hand cleaning station and deactivating device for generating the deactivating signal are both located in the food handling area.

10. A system for enhancing worker hygiene in a food handling area, the system comprising:

an indicator to be worn by a worker in the food handling area, said indicator for generating an alarm signal if it does not receive a deactivating signal within a predetermined time period;

a hand cleaning station located proximate said food handling area, said hand cleaning station for allowing the worker wearing the indicator to clean his/her hands;

a deactivating device operatively associated with said hand cleaning station, said deactivating device for emitting a deactivating signal to be received by the indicator when it is determined that the user has used said hand cleaning station; and means for causing said indicator to emit said alarm signal when said predetermined time period expires before said indicator receives said deactivating signal, whereby the worker is required to clean his/her hands at said hand cleaning station at some time during every predetermined time period in order to avoid emittance of said alarm signal thereby enhancing hand cleanliness within the food handling area.

11. The system of claim 10, wherein said means for causing said indicator to emit said alarm signal includes a timer for counting down each said predetermined time period, and resetting means for resetting said timer each time said indicator receives said deactivating signal.

12. The system of claim 11, wherein said deactivating device is located within the food handling area, and said deactivating signal includes one of an infrared (IR) or a radio frequency (RF) based signal.

13. The system of claim 12, wherein said alarm signal emitted from said indicator includes one of an audio signal, a vibration based signal, or an optical signal.

* * * * *